United States Patent [19]

Berti et al.

[11] Patent Number: 4,924,657

[45] Date of Patent: May 15, 1990

[54] METHOD AND CIRCUITRY FOR CONTROLLING THE OPERATION OF A PACKING MACHINE

[75] Inventors: Martin Berti, Steckborn; Max Frei, Mammern, both of Switzerland

[73] Assignee: SIG Schweizerische Industrie-Gesellschaft, Neuhausen am Rheinfall, Switzerland

[21] Appl. No.: 190,384

[22] Filed: May 5, 1988

[30] Foreign Application Priority Data

May 5, 1987 [CH] Switzerland ..... 1706/87

[51] Int. Cl.[5] ..... B65B 9/06; B65B 57/00

[52] U.S. Cl. ..... 53/450; 53/55; 53/75; 53/550

[58] Field of Search ..... 53/51, 55, 64, 450, 53/550, 493, 75

[56] References Cited

U.S. PATENT DOCUMENTS

| | | | |
|---|---|---|---|
| 4,525,977 | 7/1985 | Matt | 53/450 X |
| 4,549,386 | 10/1985 | Wilson | 53/550 |
| 4,712,357 | 12/1987 | Crawford | 53/450 X |
| 4,726,168 | 2/1988 | Seko | 53/51 |

*Primary Examiner*—John Sipos

*Attorney, Agent, or Firm*—Spencer & Frank

[57] ABSTRACT

A packing machine includes a supply conveyor arranged for advancing articles to be wrapped; a first motor drivingly connected to the supply conveyor; a second motor arranged for advancing a wrapper sheet codirectionally with the advance of articles; a sealing unit for periodically providing a transverse sealing seam in front of and behind each article subsequent to wrapping the article; and a third motor drivingly connected to the sealing unit. There is provided a circuit arrangement operatively coupled to the sealing unit for regulating a rotational position of the third motor. The circuit arrangement includes a computer having an input connected to the first motor for receiving data on consecutive rotational positions. To the computer there are applied data on dimensional characteristics of the articles and the wrapper sheet. The computer calculates, from the data, synchronous rotary positions of the second and third motors at least during periods when the sealing unit is in contact with the wrapper sheet. The computer applies to the first, second and third motors control signals based on the synchronous rotary positions.

7 Claims, 2 Drawing Sheets

METHOD AND CIRCUITRY FOR CONTROLLING THE OPERATION OF A PACKING MACHINE

BACKGROUND OF THE INVENTION

This invention relates to a method and a circuitry for regulating the position of at least the drive of a transverse sealing device forming part of a packing machine. The circuitry includes a first motor for driving a supply conveyor advancing the articles to be packaged, a second motor for supplying the wrapper material and a third motor for driving a sealing device which provides sealing seams oriented transversely to the advancing direction of the articles.

The basic principle of a control of the above-outlined type is known. Thus, according to U.S. Pat. No. 4,549,386 a list of data is made available by means of a microprocessor in order to synchronize the motion of the transverse sealing shoes with the drive of the article conveyor and the drive for advancing the wrapper material. This prior art system makes the initial assumption that if N number of articles are packaged per minute, then a total of 1/N minute is available for all the packaging steps Thus during such a period the article conveyor has to be moved by a distance which equals the length of one article plus the distance between two consecutive articles;

the sealing shoes have to execute a full revolution; and the wrapper material has to be fed through one whole length for packing one article.

The above-listed three courses of motion have to occur in synchronism. In order to ensure that the sealing operation is effected synchronously with the supply of the wrapper material, the motor for driving the sealing shoes has to be controlled as a function of the feed of the wrapper material. The data group supplied by the microprocessor has a first phase with constant velocity and subsequently has a second phase with increasing velocity and an adjoining phase with decreasing velocity and a concluding fourth phase with constant velocity. The sealing shoes rotate during one phase with constant velocity over the moving wrapper web. The microprocessor determines such constant velocity and adds thereto an associated peak velocity to ensure that the sealing shoes are capable of performing a full revolution. The course of motion of the sealing shoes, however, is not slippage free between the sealing shoes and the wrapper material during the engagement phase. During the sealing phase there occurs, due to the less than optimally tuned motion of the sealing shoes a tension stress of the wrapper material or an undesired crowding (gathering) thereof.

SUMMARY OF THE INVENTION

It is an object of the invention to provide an improved regulation of the position of at least the drive of the transversal sealing shoes to control not only the four phases which are rigidly coupled to one another, but also to ensure a dynamic control for the synchronism of all the drives.

This object and others to become apparent as the specification progresses, are accomplished by the invention, according to which, briefly stated, the packing machine includes a supply conveyor arranged for advancing articles to be wrapped; a first motor drivingly connected to the supply conveyor; a second motor arranged for advancing a wrapper sheet codirectionally with the advance of articles; a sealing unit for periodically providing a transverse sealing seam in front of and behind each article subsequent to wrapping the article; and a third motor drivingly connected to the sealing unit. There is provided a circuit arrangement operatively coupled to the sealing unit for regulating a rotational position of the third motor. The circuit arrangement includes a computer having an input connected to the first motor for receiving data on consecutive rotational positions. To the computer there are applied data on dimensional characteristics of the articles and the wrapper sheet. The computer calculates, from the data, synchronous rotary positions of the second and third motors at least during periods when the sealing unit is in contact with the wrapper sheet. The computer applies to the first, second and third motors control signals based on the synchronous rotary positions.

DESCRIPTION OF THE PREFERRED EMBODIMENT

Figure 1:
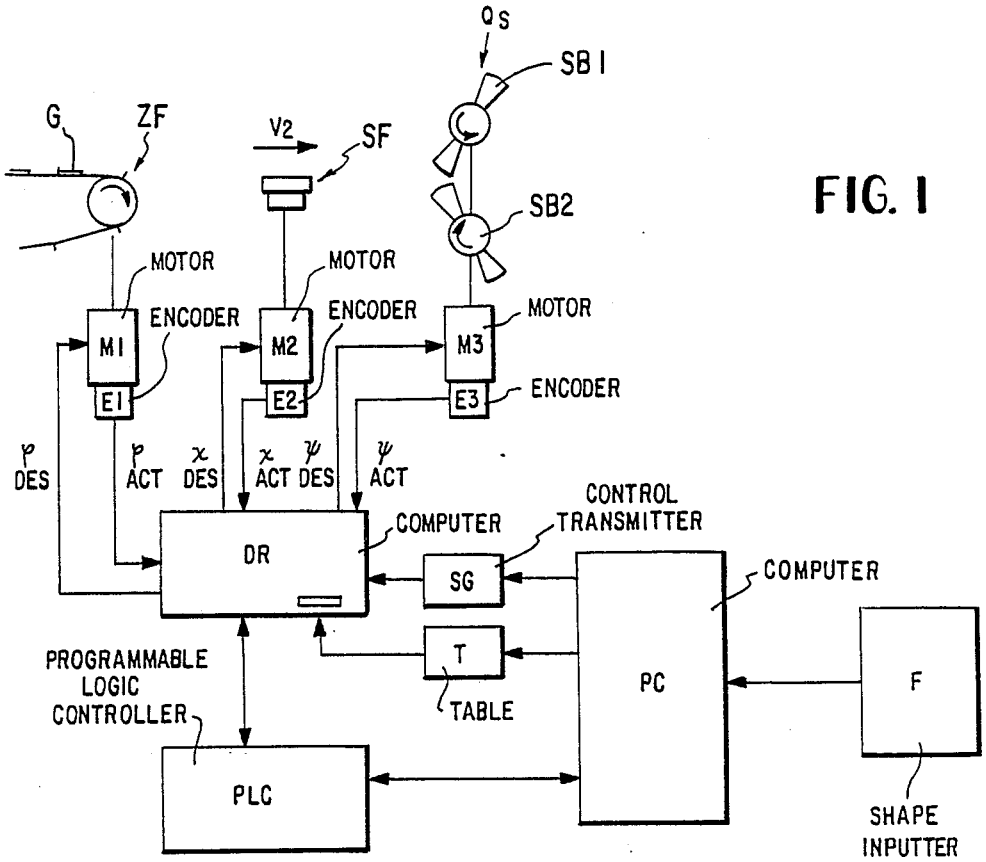
FIG. 1 is a block diagram of a preferred embodiment of the invention.

Turning to FIG. 1, there is shown a first motor M1 for driving a conveyor ZF which advances articles G spaced uniformly from one another. An encoder E1 generates increments of an angle relative to a zero position and applies the increments to a first computer DR as an actual magnitude $\phi_{act}$. As viewed in the conveying direction, downstream of the discharge end of the conveyor ZF there is situated a wrapper sleeve forming device SF whose drive is a second motor M2. The latter drives a second encoder E2 which generates increments of an angle and applies them as an actual magnitude $\chi_{act}$ to the first computer DR.

In the wrapper sleeve former SF the web-like wrapper sheet is shaped to form a sleeve or hose, wrapped around the articles about an axis parallel to the direction of article advance and closed lengthwise by a longitudinal seam. Already at this location a synchronization of the supply of the wrapper material on the conveyor ZF is required in order to prevent the articles G from being shifted relative to the wrapper sleeve while the latter envelopes the articles.

In a transverse sealing station QS two cooperating sealing shoes SB1, SB2 supported on parallel axes are, in a known manner, rotated synchronously with the feed of the wrapper material so that the sealing shoes at all times engage into the gap between two adjoining articles and pinch together the material of the wrapper hose under heat for welding the same. At this location, the circular segment-shaped sealing shoes, as shown in FIG. 4, have to roll on the material positioned between the shoes in order to transmit the heat uniformly onto the wrapper material. A slippage between the wrapper hose and the sealing shoes during the engagement phase as well as a tensioning or crowding of the material at the deformed wrapper hose during the sealing process may have adverse effects on the sealing seam and on the wrapper material itself.

Figure 2:
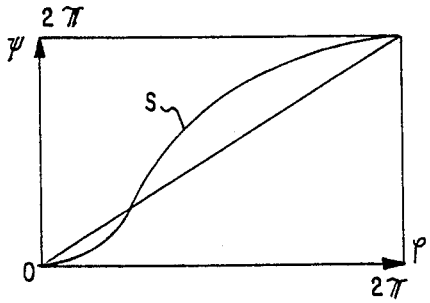
FIG. 2 is a diagram illustrating an optimal displacement curve of two components of the machine controlled by the circuitry according to the invention.

If, however, the sealing shoes are synchronized (decelerated) with respect to the travelling speed of the wrapper in order to effect a slippage-free rolling motion thereon, such a deceleration has to be compensated for after the sealing process, that is, when the sealing shoes are lifted off the wrapper. This is illustrated in FIG. 2 where the abscissa indicates the rotary angle $\phi$ of the conveyor motor M1 from 0 to $2\pi$ and the ordinate indicates the rotary angle $\psi$ of the shafts of the sealing shoes from 0 to $2\pi$. The curve S clearly indicates that the sealing shoes have at 0 and $2\pi$ a lesser speed than at angle values in between so that during the engagement phase with the wrapper and the sealing phase a synchronism is present. The deceleration is compensated for by a greater angular velocity at approximately $\pi/2$.

Figure 3:
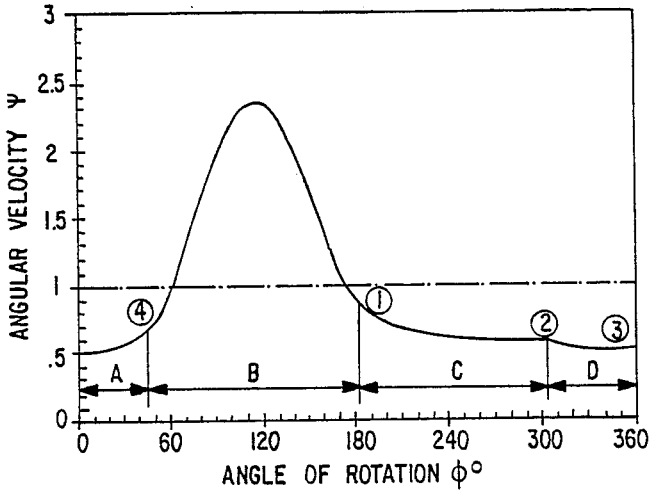
FIG. 3 is a diagram showing the angular velocity of a component as a function of the angle of rotation of another component.
Figure 4A:
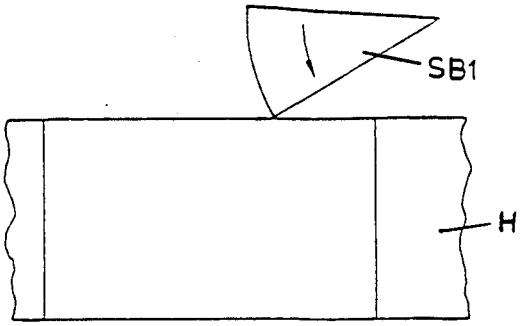
FIGS. 4*a*–4*d* are schematic side elevational views of a sealing device shown in consecutive phases during operation.
Figure 4B:
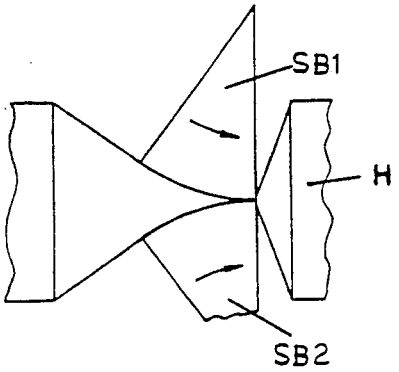
Figure 4C:
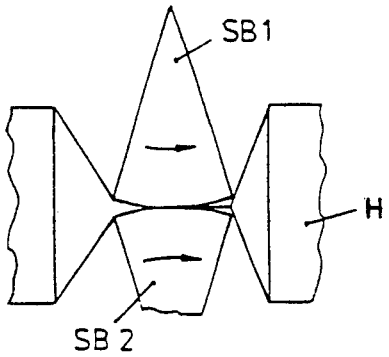
Figure 4D:
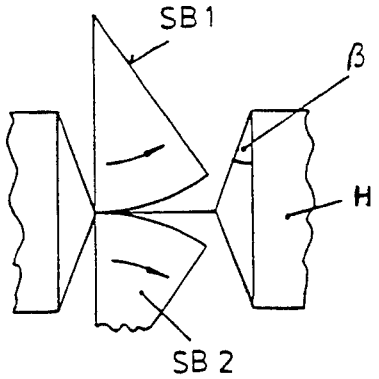

The above-noted velocity relationships are illustrated in FIG. 3. The abscissa, similarly to FIG. 2, indicates the rotary angle $\phi$ of the motor M1 of the conveyor ZF as reported by the encoder 1. The ordinate illustrates the angular velocity $\dot{\psi}$ of the motor M3 of the sealing shoes as reported by the encoder E3. Four phases may be clearly distinguished: phase A = sealing process; phase B = return stroke; phase C = engagement; and phase D = sealing. The phases A and D may be considered together as a single phase. The mutual positions of the sealing shoes S1, S2 and the wrapper hose H are illustrated in FIGS. **4*a*–4*d*. FIG. 4*a* illustrates the relative position of the hose and the sealing shoe SB1 (the sealing shoe SB2 is not shown in FIG. 4*a*) at the end of the return stroke or, as the case may be, at the beginning of the flattening phase; FIG. 4*b* shows the end of the flattening phase, that is, the beginning of the sealing phase; FIG. 4*c* indicates the position at mid point through the sealing operation and FIG. 4*d*** indicates the end of the sealing phase.

For an exact synchronous control of all three drives having motors M1, M2 and M3 the encoders E1, E2 and E3 report to the first computer DR, functioning as a digital drive regulator, the momentary incremental angle step $\phi$ of the motor M1, the angle step $\chi$ of the motor M2 and the angle step $\psi$ of the motor M3.

A second higher-order computer PC is associated with the first computer DR and fulfills an intelligence function permitting a flexibility of the entire packing machine. A shape inputter F makes available for the second computer PC data which are the configurational data of the articles G and the data concerning the wrapper material and further, data relating to the heat output of the sealing shoes SB1, SB2. With these data, for which information is also made available from the first computer DR through a freely programmable control (programmable logic controller) PLC, the second computer PC formulates a table T for the angle position $\psi$ of the third motor M3 as a function of the angle $\phi$ of the first motor M1, whereby all the points of the curve according to FIG. 2 are determined.

The packing cycle is determined by the cadence of advance of articles G by the supply conveyor ZF. To ensure that such a condition is established, the motor M1 is designated as a principal motor, that is, as a command unit. The two other motors M2 and M3 are then subordinated (commanded) units or secondary motors. Accordingly, the first computer DR applies control signals to all three motors, that is, a $\phi_{des}$ signal to the motor M1, a $\chi_{des}$ signal to the motor M2 and a $\psi_{des}$ signal to the motor M3.

In order to determine the packing cycle, in addition to the table T for the tabular inputting of the points for the curve according to FIGS. 2 and 3, a control transmitter SG applies to the first computer DR further data for the pull-off length of the wrapper hose which have to be consistent with the configurational data of the articles.

The above-described arrangement ensures that, above all, a positional control of the sealing shoes SB1 and SB2 is effected in an optimal manner. By utilizing AC servomotors which are practically maintenance-free, very high dynamics can be achieved. As a result, the return stroke of the sealing shoes may be well controlled for more than one sealing shoe per shaft. For reporting back the positions, a simple encoder suffices. For the regulation of the motor position a phase regulating circuit suffices in which the motor current is directly controlled. The motor M3 drives directly the shaft of the sealing shoes SB1. The simplifications achieved in this manner permit a construction with low intensity and result in high dynamics.

The present disclosure relates to subject matter contained in Swiss Patent Application No. 1706/87-0 (filed May 5th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of operating a packaging machine including a supply conveyor arranged for advancing articles to be wrapped; a first motor drivingly connected to the supply conveyor; a second motor arranged for advancing a wrapper sheet codirectionally with the advance of articles; transverse sealing means for periodically providing a transverse sealing seam in front of and behind each article subsequent to wrapping the article in said wrapper sheet; and a third motor drivingly connected to said transverse sealing means; comprising the following steps:

(a) applying, to a computer means, data on consecutive rotational positions of said third motor;

(b) applying, to said computer means, data on dimensional characteristics of the articles and the wrapper sheet;

(c) calculating, with said computer means, synchronous rotary positions of said second and third motors from said data at least during periods when said transverse sealing means is in contact with said wrapper sheet; the rotary positions of said third motor being calculated such that the angular velocity of said third motor, related to corresponding angular positions of said first motor, decreases non-linearly from the beginning of an engagement phase and the angular velocity of said third motor varies during a sealing phase of said transverse sealing means for ensuring throughout a slippage-free contact between the transverse sealing means and the wrapper sheet; and (d) applying, by said computer means, control signals, derived from the calculated rotary positions, to said first, second and third motors.

2. A method as defined in claim 1, wherein the computer means comprises a first, subordinated computer and a second, higher-order computer operatively coupled to the first computer; further wherein said calculating step is performed by said second computer; further comprising the step of applying the calculated data in tabular form from said second computer to said first computer; and further wherein the control signals are applied to said first, second and third motors by said first computer.

3. In a packing machine including a supply conveyor arranged for advancing articles to be wrapped; a first motor drivingly connected to the supply conveyor; a second motor arranged for advancing a wrapper sheet codirectionally with the advance of articles; transverse sealing means for periodically providing a transverse sealing seam in front of and behind each article subsequent to wrapping the article in said wrapper sheet; and a third motor drivingly connected to said transverse sealing means; the improvement comprising a circuit arrangement operatively coupled to said transverse sealing means for regulating a rotational position of said third motor; said circuit arrangement including a first, subordinated computer having an input connected to said first motor for receiving data on consecutive rotational positions of said first motor; a second, higher-order computer connected to said first computer; said second computer having an input for receiving data on dimensional characteristics of the articles and the wrapper sheet; said second computer being arranged for calculating, from said data, synchronous rotary positions of said second and third motors at least during periods when said transverse sealing means is in contact with said wrapper sheet; the rotary positions of said third motor being calculated such that the angular velocity of said third motor, related to corresponding angular positions of said first motor, decreases non-linearly from the beginning of an engagement phase and the angular velocity of said third motor varies during a sealing phase of said transverse sealing means for ensuring throughout a slippage-free contact between the transverse sealing means and the wrapper sheet; further wherein said first computer includes outputs connected to said first, second and third motors to apply thereto control signals representing the calculated rotary positions.

4. A packing machine as defined in claim 3, wherein said first motor is a commanding unit and said second motor is a commanded unit.

5. A packing machine as defined in claim 4, wherein said second and third motors are AC servomotors.

6. A packing machine as defined in claim 3, wherein said sealing means comprises two parallel shafts and cooperating sealing shoes mounted on respective said shafts.

7. A packing machine as defined in claim 6, wherein said sealing shoes have an outline shaped as a circular segment.

* * * * *